US009228411B2

(12) United States Patent
Themig

(10) Patent No.: US 9,228,411 B2
(45) Date of Patent: Jan. 5, 2016

(54) WELLBORE PACKER BACK-UP RING ASSEMBLY, PACKER AND METHOD

(75) Inventor: Daniel Jon Themig, Calgary (CA)

(73) Assignee: PACKERS PLUS ENERGY SERVICES INC., Calgary (CA)

( * ) Notice: Subject to any disclaimer, the term of this patent is extended or adjusted under 35 U.S.C. 154(b) by 289 days.

(21) Appl. No.: 13/877,791

(22) PCT Filed: Oct. 6, 2011

(86) PCT No.: PCT/CA2011/001152
§ 371 (c)(1),
(2), (4) Date: Apr. 4, 2013

(87) PCT Pub. No.: WO2012/045168
PCT Pub. Date: Apr. 12, 2012

(65) Prior Publication Data
US 2013/0192853 A1 Aug. 1, 2013

Related U.S. Application Data

(60) Provisional application No. 61/390,568, filed on Oct. 6, 2010.

(51) Int. Cl.

| | |
|---|---|
| ***E21B 23/06*** | (2006.01) |
| ***E21B 33/128*** | (2006.01) |
| ***E21B 33/129*** | (2006.01) |
| ***E21B 33/12*** | (2006.01) |

(52) U.S. Cl.
CPC ..... *E21B 33/129* (2013.01); *E21B 33/128* (2013.01); *E21B 33/1216* (2013.01)

(58) Field of Classification Search
CPC .... E21B 23/06; E21B 33/1208; E21B 33/128
See application file for complete search history.

(56) References Cited

U.S. PATENT DOCUMENTS

| | | | |
|---|---|---|---|
| 3,035,639 | A | 5/1962 | Brown et al. |
| 3,109,493 | A | 11/1963 | Carter |
| 3,371,716 | A | 3/1968 | Current |
| 4,288,082 | A | 9/1981 | Setterberg, Jr. |
| 4,396,066 | A | 8/1983 | Akkerman et al. |
| 4,611,658 | A | 9/1986 | Salerni et al. |

(Continued)

FOREIGN PATENT DOCUMENTS

| | | |
|---|---|---|
| EP | 1197632 | 4/2002 |
| EP | 1753936 | 2/2007 |

(Continued)

OTHER PUBLICATIONS http://c14503045.r45.cf2.rackcdn.com/v1/54610a3c8e4c2f6463ae6d890589b274/27327-linerhanger_catalog-1110.pdf Line Hanger Systems; Baker Hughes; pp. 39-42 & 44; 2010.

(Continued)

*Primary Examiner* — Catherine Loikith
(74) *Attorney, Agent, or Firm* — Bennett Jones LLP

(57) ABSTRACT

A back-up ring assembly for a wellbore packer that acts as an extrusion limiter for a packing element and engages the wellbore bore, also operating as a slip to anchor the packer in place. A wellbore packer includes a back-up ring that includes a gripping structure on its outer wall-contacting surface that acts both to back up the extrusion of the packing element and to engage the wellbore wall.

127 Claims, 3 Drawing Sheets

(56) References Cited

U.S. PATENT DOCUMENTS

| | | | | |
|---|---|---|---|---|
| 4,784,226 | A | 11/1988 | Wyatt | |
| 5,014,782 | A | 5/1991 | Daspit | |
| 5,176,217 | A | 1/1993 | Luke et al. | |
| 5,333,692 | A | 8/1994 | Baugh et al. | |
| 5,839,515 | A | 11/1998 | Yuan et al. | |
| 6,056,052 | A | 5/2000 | Mullen et al. | |
| 6,666,276 | B1 | 12/2003 | Yokley et al. | |
| 6,769,491 | B2 | 8/2004 | Zimmerman et al. | |
| 7,373,973 | B2 | 5/2008 | Smith et al. | |
| 2002/0070503 | A1* | 6/2002 | Zimmerman et al. | 277/337 |
| 2005/0189103 | A1 | 9/2005 | Roberts et al. | |
| 2005/0189121 | A1 | 9/2005 | Doane et al. | |
| 2008/0093086 | A1 | 4/2008 | Courville et al. | |
| 2009/0065191 | A1 | 3/2009 | Reid et al. | |
| 2009/0126925 | A1* | 5/2009 | Guest et al. | 166/118 |
| 2010/0186970 | A1 | 7/2010 | Burnett et al. | |
| 2010/0288513 | A1 | 11/2010 | Turley et al. | |

FOREIGN PATENT DOCUMENTS

| | | | |
|---|---|---|---|
| EP | 2221447 | A2 | 8/2010 |
| GB | 2091318 | | 7/1982 |
| WO | WO 02/46573 | | 6/2002 |
| WO | 2010059591 | | 5/2010 |

OTHER PUBLICATIONS

Supplementary European Search Report for EP11830165, Aug. 13, 2015, Munich.

* cited by examiner

WELLBORE PACKER BACK-UP RING ASSEMBLY, PACKER AND METHOD

FIELD OF THE INVENTION

A wellbore tool is disclosed. In particular, the invention relates to a wellbore packer and back-up ring assembly.

BACKGROUND

Wellbore packers are known that are used to create a seal in a wellbore. The term "wellbore packer" may be used to also encompass a bridge plug, a straddle tool, etc., all of which are employed in wellbore operations to control fluid flow. A wellbore packer is deployed in a well to be expanded between a mandrel and a constraining wall, such as an open wellbore wall, a lined wellbore wall or another liner. The mandrel may have an open bore or may be sealed against fluid flow. The mandrel is often part of a larger structure, such as a wellbore string.

Sometimes, a wellbore tool is needed that operates both to create a seal about, and anchor, the mandrel in a wellbore. Such a tool has a requirement for both a sealing mechanism and an anchoring mechanism. As such, some packers have both a sealing element and mechanism for expanding that sealing element and a separate anchoring slip system and a mechanism for driving the slips against the constraining wall in which the tool is positioned.

The packing element is often formed of deformable materials such as rubber or other elastomers and is squeezed with compression, either mechanically applied or hydraulically applied. When the packing element is squeezed out, it expands radially outwardly and is driven into contact against the constraining wall in which the tool is positioned. At the same time, the backside of the packing element is sealed up against the mandrel and a seal is achieved. The best seal is achieved when the packing element is kept from axially extruding, as such extrusion may lead to seal damage and failure.

The anchoring slip system, for example, may include a cone system including an inclined frustoconical wedge that forces the slip against the constraining wall in which the tool is positioned. It may also contain a ratcheting device called a mandrel lock that locks the slip in the anchored position.

The anchoring slip system is offset axially along the mandrel from the packing element.

SUMMARY

In accordance with a broad aspect of the invention, there is provided a wellbore packer back-up ring assembly for limiting the extrusion of a packing element comprising: a first back-up ring adapted to be positioned about a mandrel at a first end of the packing element; and a second back-up ring adapted to be positioned about the mandrel spaced from the first back-up ring and at a second end of the packing element; wherein the first back-up ring and the second back-up ring each include an inner facing annular surface and an outer facing annular surface defining an outer diameter across the back-up ring and including a gripping structure capable of biting into a constraining surface in a well and each being expandable to increase the outer diameter to expand radially outwardly.

In accordance with another broad aspect of the invention, there is provided a wellbore packer comprising: a mandrel, a deformable packing element surrounding the mandrel and adapted to be radially expanded out from the mandrel, the deformable packing element including an end; a back-up ring surrounding the mandrel and positioned adjacent the end of the deformable packing element, the back-up ring having an inner facing annular surface and an outer facing annular surface defining an outer diameter across the back-up ring, the back-up ring being expandable to increase the outer diameter to expand out from the mandrel alongside the deformable packing element and the outer facing annular surface including a gripping structure capable of biting into a constraining surface in a well.

In accordance with another broad aspect, there is provided a method for sealing an annular area in a wellbore, comprising: positioning a wellbore packer in a wellbore adjacent a constraining wall, the wellbore packer including a mandrel, a deformable packing element surrounding the mandrel and adapted to be radially expanded out from the mandrel, the deformable packing element including an end; a back-up ring surrounding the mandrel and positioned adjacent the end of the deformable packing element, the back-up ring having an inner facing annular surface and an outer facing annular surface defining an outer diameter across the back-up ring, the back-up ring being expandable to increase the outer diameter to expand out from the mandrel alongside the deformable packing element and the outer facing annular surface including a gripping structure; driving the back-up ring to expand radially outwardly to increase the outer diameter and to drive the gripping structure into engagement with the constraining wall; and applying a force on the deformable packing element to expand it radially outwardly such that it fills a gap between the back-up ring, the mandrel and the constraining wall.

It is to be understood that other aspects of the present invention will become readily apparent to those skilled in the art from the following detailed description, wherein various embodiments of the invention are shown and described by way of illustration. As will be realized, the invention is capable for other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

Referring to the drawings, several aspects of the present invention are illustrated by way of example, and not by way of limitation, in detail in the figures, wherein.

DESCRIPTION OF VARIOUS EMBODIMENTS

Figure 1:
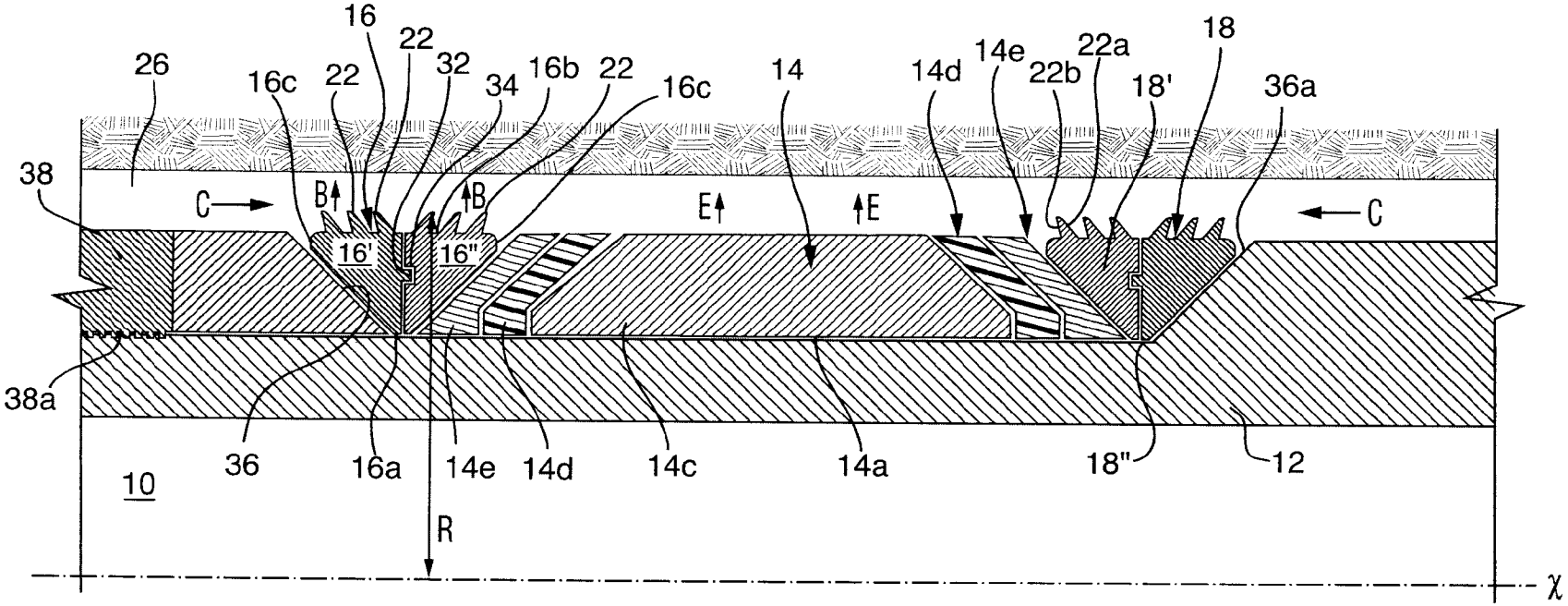
FIG. 1 is an enlarged, longitudinal section through a packer.

The description that follows, and the embodiments described therein, is provided by way of illustration of an example, or examples, of particular embodiments of the principles of various aspects of the present invention. These examples are provided for the purposes of explanation, and not of limitation, of those principles and of the invention in its various aspects. In the description, similar parts are marked throughout the specification and the drawings with the same respective reference numerals. The drawings are not necessarily to scale and in some instances proportions may have been exaggerated in order more clearly to depict certain features.

A packing element back-up system has been invented that acts to limit packing element extrusion and also serves to anchor a packer in a wellbore. A packer has been invented including a packing element back-up system that also serves as an anchoring slip system. A method for sealing a wellbore has also been invented.

Back-up rings act as extrusion limiters and supports for the packing element. For example, a back-up ring may surround the packer mandrel on one or both ends of the packer element. The back-up ring can expand radially out to increase its outer diameter, and sometimes its radial thickness, when a driving force such as compression is applied thereto. The back-up ring can expand out to close any gap through which the packing element might otherwise extrude axially. As such, the packer element may be supported and backed up by the back-up ring to prevent axial extrusion and breakdown of the packer element.

The back-up ring is an annular structure capable of radial expansion in response to a driving force. In one embodiment, the back-up ring is a solid ring formed of a material, such as polytetrafluoroethylene (PTFE, Teflon™) or titanium, which is capable of radial expansion. In another embodiment, the back-up ring may include an annular member with a spiral cut extending along at least some portion of the ring's circumference which may radially expand by slipping along the spiral cut. In such a ring, a complete annular wall structure is maintained even though the ring expands because the sides along the spiral cut maintain an overlapping arrangement when the ring expands. In another embodiment, the back-up ring includes a slit cut through its thickness to allow radial expansion of the ring. However in such a ring, generally there will be a plurality of rings that overlap axially such that the slit of the ring, when expanded and therefore pulled open, does not form an opening through which the packing element can extrude. At least one ring of the plurality of rings is therefore capable of radial expansion, as by including a slit, being formed in the shape of a C or a helical member.

Figure 2:
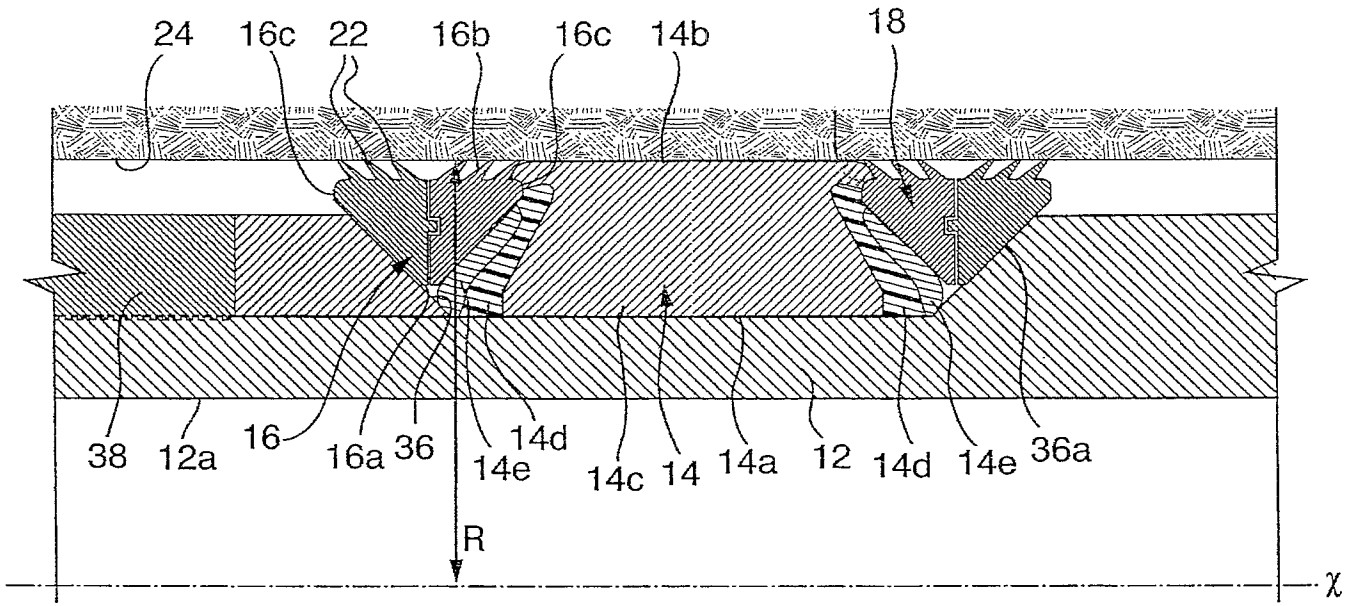
FIG. 2 is an enlarged, longitudinal section through the packer of FIG. 1 following expansion of the packer.

With reference to FIGS. 1 and 2, for example, a portion of a wellbore packer 10 is shown. Packer 10 includes a mandrel 12, a deformable packing element 14 surrounding the mandrel and adapted to be radially expanded out from the mandrel; and a back-up ring 16 surrounding mandrel 12 and positioned adjacent an end of the deformable packing element such that the packing element is able to contact it when radially expanded. While some packers may include only one back-up ring, the present packer includes a second back-up ring 18 positioned adjacent the opposite end of the packing element. In this embodiment, the two back-up rings are substantially similar in form and operation and, therefore, the description of one applies to the other. To facilitate understanding, therefore, the following description will focus on back-up ring 16.

Back-up ring 16 has an inner facing annular surface 16*a* and an outer facing annular surface 16*b* and side walls 16*c* extending therebetween. The outer facing annular surface defines an outer radius R for the back-up ring, as installed, measured from the packer center axis x. Back-up ring 16 is radially expandable, arrows B, to increase the outer radius and when expanded (FIG. 2) ring 16 extends out a distance from the mandrel alongside the deformable packing element 14 than the distance it extended before expansion.

Outer facing annular surface 16*b* includes one or more gripping structures 22 thereon capable of biting into a constraining wall 24 in a well in which the packer is positioned. As such, outer facing annular surface 16*b* of the back-up ring acts like a slip to anchor the packer when expanded out into engagement with the constraining surface.

In use, packer 10 may be employed to create a seal in an annular area in a wellbore. To do so, packer 10 is positioned in a wellbore adjacent constraining wall 24 with an annular area 26 between them (FIG. 1). The back-up ring and the deformable packing element are then driven to expand. This expansion may be simultaneous or one at a time. However, in the end as shown in FIG. 2, back-up ring 16 expands radially outwardly to increase the outer radius R and to drive the gripping structure 22 into engagement with the constraining wall and deformable packing element 14 is expanded radially outwardly such that it substantially fills a gap between side wall 16*c* of the back-up ring, mandrel 12 and constraining wall 24.

Mandrel 12 acts as a support for the other packer elements. In this embodiment, mandrel 12 is a robust tubular member having a generally cylindrical outer surface. The mandrel may have a center bore 12*a*, as shown, or have a solid body, depending on the nature of the seal that is desired to be installed. Mandrel 12 may be a portion of a wellbore string or a tool body.

Packing element 14 is often formed of deformable materials such as rubber or other elastomers and upon application of compressive forces, arrows C, thereto is squeezed radially out, arrows E. When the packing element is squeezed out, FIG. 2, its outer facing surface 14*b* is driven into contact with constraining wall 24 and at the same time, the backside 14*a* of packing element 14 becomes pressed against the mandrel. As such, element 14 forms a seal in the annular area between the mandrel and the constraining wall such that fluids are prevented from passing through the annular area.

In the illustrated embodiment, deformable packing element 14 includes a plurality of components including a main, annular sealing element 14*c*, and deformable guide rings 14*d*, 14*e*. The guide rings are positioned at the edges of the main sealing element and, while deformable, are generally more durable than the main element. Thus, they transition the forces through the packing element and prevent edge damage. Rings 14*d*, 14*e* may be formed of various materials that are deformable, likely have a hardness greater than the main element 14*c* and have a hardness less than back-up rings 16, 18. For example, rings 14*d*, 14*e* may be formed of a harder durometer rubber than element 14*c*, a filled-rubber (for example rubber reinforced with metal, for example steel, fibers), a deformable metal (for example, brass or some steels), or a plastic. In the illustrated embodiment, for example, element 14*c* is formed of rubber, ring 14*d* is formed of PTFE, ring 14*e* is formed of a deformable metal softer than brass and rings 16, 18 are formed of brass.

Back-up rings 16, 18 act as supports for packing element 14 and limit its axial extrusion, relative to the mandrel long axis x. Back-up ring 16, for example, surrounds mandrel 12 alongside element 14 and can be expanded radially out to increase its outer radius R and when a driving force such as compression, arrows C, is applied thereto. The back-up ring can expand out to close any gap through which the packing element might otherwise extrude axially. As such, back-up rings 16, 18 support and back-up packing element 14 to guide it into engagement with the constraining wall over a controlled axial length such that the sealing force is concentrated in this area and to prevent axial extrusion and breakdown of the packing element.

Back-up rings 16, 18 are annular structures capable of radial expansion in response to a driving force. In this illustrated embodiment, back-up rings 16, 18 each include a pair of sub rings. In a multipart back-up ring, at least one of the sub rings can expand. In this embodiment, each sub ring 16', 16" has a cut (cannot be seen) extending through the thickness thereof such that each ring can expand by pulling apart at the cut. As a result of the cut, the sub rings 16', 16" each have a C-shaped form. In the non-expanded position, the cut is generally closed tight, substantially without any open gap between the cut ends. When an expansive force is applied, each sub ring pulls apart at its cut and expands to increase its diameter. While the cuts allow for sub ring expansion, they are kept to a minimum to limit openings for element extrusion. For example, generally each sub ring 16', 16" has at most one cut such that it can expand, but presents only one possible opening through which extrusion can occur and it remains as one piece even when expanded. The cut can be made along a plane parallel with the center axis x. However, such a cut does create an opening extending fully through the ring or sub ring along axis x, which presents a direct path for extrusion. As such a cut that extends along a plane parallel with the center axis x should be limited and for example, limited to use in a ring where there is structure, such as a sub ring or guide ring, to block any extrusion fully through the back-up ring, as described herein below. Where there is no structure in a blocking position relative to the cut, to further limit extrusion through the cut, it can be made along a plane out of parallel with the axis x such that there is no direct axial path through the back up ring.

Rings 16', 16" are positioned in side-by-side relation and arranged that the axis of one sub ring 16' is substantially coaxial with the axis of the other sub ring 16". Also, the inner diameter of one sub ring 16' no greater than the outer diameter of the other sub ring 16" such the sub rings overlap along the long axis of mandrel. Sub rings 16', 16" are connected but rotationally moveable each to the other about their center axes. In the illustrated embodiment, for example, sub rings 16', 16" are connected through interfacing sides having connecting male and female parts. For example, sub ring 16' has an annular protrusion 32 extending about its interfacing side and sub ring 16" has an annular groove 34 extending about its interfacing side. Protrusion 32 and groove 34 are selected to have similar curvature and sufficient tolerances such that the sub rings can slip rotationally relative to each other, for example, when they are expanding, but hold together and substantially act as a unitary member in the radial direction.

In use, sub ring 16' is rotated relative to sub ring 16" such that the cut in one does not line up with the cut in the other. As such, the cut of sub ring 16', when expanded and therefore pulled open does not form an opening fully through the back-up ring through which the packing element could extrude. Instead, any extrusion through the one sub ring at the opening at the cut is stopped by a solid wall of the other sub ring.

One or, as shown, both sub rings 16', 16" of back-up ring 16 include gripping structures 22 on their outer facing surface. Gripping structures 22 may include teeth (wickers) (as shown), grit, surface roughening formed on the material of the ring or through material inserts (such as buttons, sand, diamonds, etc). As such, when the sub ring 16 is expanded out, gripping structures 22 anchor into constraining wall 24. Gripping structures 22 may be selected to dig into a casing surface by 0.010 to 0.030 inch and therefore need only be 0.050 to 0.060 inches high.

The gripping structures are formed to resist axial movement of the packer along wall 24. In some embodiments, gripping structures 22 can be formed to be directional, to resist axial movement of the packer in a certain direction (up or down). For example, gripping structures 22 can be angled to resist axial movement in one direction while allowing it in another direction. With reference to ring 18, angled gripping structures include a slipping side 22*a*, which defines an obtuse angle relative to the direction of movement, and a gripping side 22*b*, which has an orthogonal or acutely angled side relative to the direction of movement. The illustrated gripping structures 22 are each angled to resist axial movement in one direction, with those on sub rings 16', 18' resisting movement towards the left (towards surface) and those on sub rings 16", 18" resisting movement towards the right (further downhole). However, since structures 22 on sub rings 16', 18' are oppositely angled to the structures on sub ring 16", 18" each ring 16, 18 resists movement in both the axially upward and the axially downward directions.

The expansion of rings 16, 18 may be driven in a number of ways. In the illustrated embodiment, expansion force is driven by frustoconical guide surfaces 36, 36*a* carried on the mandrel in cooperation with a compressive force exerted by actuating member 38. In this embodiment, the compressive force is applied to rings 16, 18 and element 14 by actuating member which includes a single drive ring that drives the components against a fixed shoulder at surface 36*a*. Since shoulder 36*a* cannot move, any force applied by member 38 results in a compressive force along the entire arrangement of components 14, 16 and 18. However, it is to be understood that drivers could be positioned at both ends, if desired.

Back-up ring 16, for example, surrounds mandrel 12 and is positioned adjacent surfaces 36, 36*a* in a position to be lifted by it, when surface 36 is urged beneath the ring. For example, when a compressive force is exerted by member 38, guide surface 36 passes beneath ring 16 and acts to move ring 16 radially outwardly into contact with constraining wall 24. As will be appreciated, the outer diameter of the mandrel at surfaces 36, 36*a* and the thickness of rings 16, 18 must be selected with consideration as to the distance across annular space 24.

To more efficiently and stably translate compressive axial motion into radially directed force to drive ring 16 radially outwardly, inner facing annular surface 16*a* may be shaped frustoconically to have an angled face substantially similar to that of frustoconical guide surface 36.

The compressive force, arrows C, is also applied to packing element 14 to expand the element radially into contact with constraining wall 24. Ring 16, being radially expanded against wall 24, supports the respective ends of element 14 during deformation. FIG. 2 shows packing element 14 following deformation and expansion into contact with constraining wall 24. During application of compressive force, the packing element is urged radially outwardly and rings 16, 18 travel along the frustoconical guide surfaces 36, 36*a* and are thus pushed radially outwardly. This positions the rings to support the axial ends of the packing element 14, thereby preventing extrusion of the packing element axially along the annular space 26 and thus holds element 14 in a shape which provides a good sealing abutment with wall 24.

In the illustrated embodiment, ring 16 is also frustoconically formed on its inner facing annular surface 16*a* adjacent element 14. In particular, the inner facing annular surface 16*a* of sub ring 16' is formed to taper inwardly and the adjacent edge of element 14, in this embodiment, ring 14*e*, is frustoconically formed to protrude beneath ring 16. As compressive forces urge the parts to axially compress, ring 16 tends to move radially outwardly ahead of element 14 to reach its abutting position against wall 24 ahead of the full expansion of the packing element, such that advantageously element 14 tends not to become pinched between ring 16 and wall 24 and therefore cannot block the gripping engagement of structures 22 with wall 24.

Member 38, or member 36, may include a lock structure 38*a* to lock the compressive force into the packer. For example, member 38 may include a body lock ring structure such as a ratchet. The lock structure may be releasable if it is desirable to have an option to unset the packer.

The foregoing packer allows the elimination of a separate anchoring system. The combined functions of, extrusion limiting and anchoring, back-up ring 16 may allow a reduction in the total length and complexity of a packer, but without losing functionality. Also, only one lock structure need be employed, further reducing the overall packer length.

Figure 3:
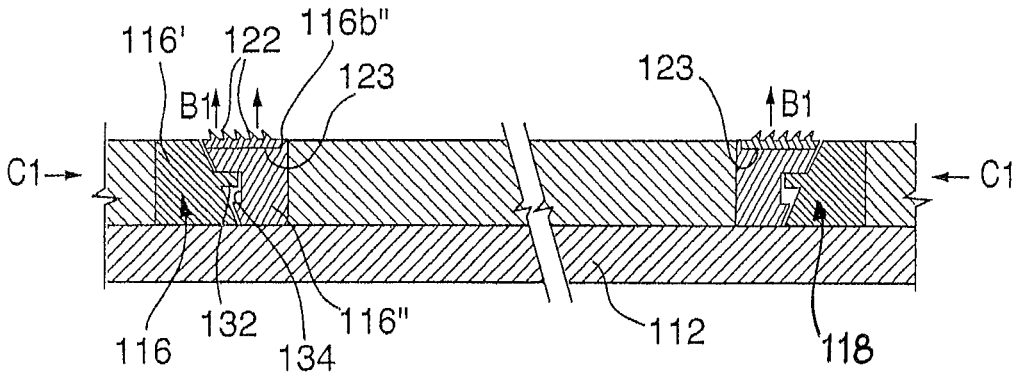
FIG. 3 is a sectional view through another packer.

Another packer with back-up rings 116, 118 is shown in FIG. 3. Back-up rings 116, 118 are also multipart rings having a pair of sub rings 116', 116" positioned in side-by-side relation. However, in this embodiment, only one sub ring 116" of the two sub rings expands outwardly and only that sub ring has gripping structures 122 on its outer facing annular surface 116*b"*.

Ring 116' is a base, sliding sub ring and sub ring 116" is capable of radial expansion. Sub rings 116', 116" are positioned in side-by-side relation such that they overlap along the long axis of mandrel even when sub ring 116" is fully expanded. Sub rings 116', 116" are connected but rotationally moveable each to the other about a center axis. In the illustrated embodiment, for example, sub rings 116', 116" are connected through interfacing sides having connecting male and female parts. For example, sub ring 116' has an annular protrusion 132 extending about its interfacing side and sub ring 116" has an annular groove 134 extending about its interfacing side. Protrusion 132 and groove 134 are selected to have similar curvature and sufficient tolerances such that the sub rings can slip rotationally relative to each other. For example, when sub ring 116" expands, it can radially expand relative to sub ring 116', but the interaction of the protrusion and the groove prevent the sub rings from falling apart in use.

Ring 116" is cut through its thickness at one point along its circumference such that it can expand. Since sub ring 116" expands out away from sub ring 116', the opening that forms at the cut when the sub ring is expanded is not blocked by any other member. Thus, the cut extends slightly helically and is not directly along a path parallel to the axis, as this deters extrusion through the opening that forms at the cut.

Unlike the back-up ring of FIG. 1, ring 116 expands upon itself because sub rings 116', 116" have reverse frustoconical forms on their interfacing sides. In particular, base sub ring 116' has a protruding frustoconical surface (an obtusely angled face) on its interfacing side against which an undercut frustoconical surface (acutely angled face) of the expandable sub ring 116" is set. The frustoconical curvatures along the interfacing sides are substantially mirror images of each other. Axial compression, arrows C1, against the sides of the ring, therefore, is reacted to force expandable sub ring 116" to expand radially outwardly. In particular, compression causes sub ring 116" to ride up along the frustoconically formed face of sub ring 116'. As force is applied, arrow C1, the inclined faces cause the parts to shift on each other, such that: sub ring 116" moves up, arrow B1, in particular, radially outwardly relative to the other sub ring 116', which is restrained from behind by mandrel 112, such that it substantially can't move.

In this embodiment, rings 116, 118 each have gripping structures 122 to engage the constraining well against which they are expanded. In this embodiment, rings 116, 118 are formed of a durable metal such as brass, but which is softer than steel, the material from which the constraining wall may be formed. As such, gripping structures 122 are formed on inserts 123, for example buttons, diamond, sand, that are installed in the outer surfaces of the expandable rings. Inserts 123 may include or be formed of materials harder than steel such as carbide, diamond, sand, etc.

Gripping structures 122, in this embodiment, are in the form of angled teeth to permit sliding movement inwardly along the direction compressing element 114 but to resist any axial movement in the reverse direction. As such, rings 116, 118 tend not to resist any compressive movement after biting into the constraining wall and allow continued compression if necessary to completely expand element 114.

Rings 116, 118, therefore, expand in diameter when compressed and act as a back-up, to guide the expansion of the packing element. The packing element 114 comes into contact with the ring but cannot extrude past it. The back-up rings are directly adjacent the packing element act at each end thereof and act to constrain the packing element and to reduce the area where the rubber can try to extrude during pressuring and temperature operations. In addition, rings 116, 118 act as slips to anchor the packer against axial sliding movement along the wellbore.

Figure 4:
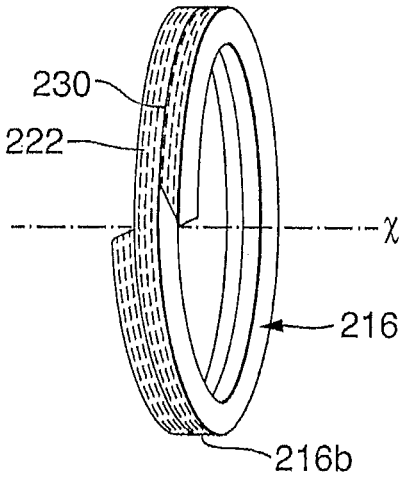
FIG. 4 is a side perspective view of another back-up ring.

In another embodiment, as shown in FIG. 4, a back-up ring 216 may include an annular member with a spiral cut 230 extending along at least some portion of the ring's circumference. The ring may radially expand by slipping along the spiral cut. In such a ring, a complete annular wall structure is maintained even though the ring expands because the sides along spiral cut 230 maintain an overlapping arrangement when the ring expands. Outer facing annular surface 216*b* includes gripping structures 222 thereon such as teeth formed as elongate annular ridges. In this embodiment, gripping structures 222 are formed to allow rotational sliding of ring about its center axis x, to permit the ring to retain some ability to continue expansion even after contacting the constraining wall. However, structures 222 are formed to resist axial sliding of ring 216, along axis x, in at least one direction after the ring has contacted a constraining wall.

In another embodiment, the back-up ring is a solid ring formed of a material, such as PTFE or titanium, which is capable of radial expansion and carries gripping structures on its outer facing annular surface. However, care may be taken to ensure that the material of the ring is sufficiently strong to effectively act as an anchor for the packer. Generally, therefore, a back-up ring according to this invention is formed of material including metal such as brass, steel, titanium or a polymer filled with metal and has an incomplete ring form, such as by inclusion of an axial or spiral cut.

In the present invention, instead of a separate anchoring mechanism and back-up rings, a combined function back-up ring is provided. The back-up rings instead of serving one purpose, both reduce the extrusion gap and also to anchor into the surrounding structure. As noted above, this allows a simpler and shorter packer to be constructed. Separate slips may not be necessary and in fact it is desired to provide a packer tool without a separate slip assembly.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

I claim:

1. A wellbore packer back-up ring assembly for limiting the extrusion of a packing element in a packer comprising;

a first back-up ring adapted to be positioned about a mandrel at a first end of the packing element; and a second back-up ring adapted to be positioned about the mandrel spaced from the first back-up ring and at a second end of the packing element; wherein the first back-up ring and the second back-up ring each include an inner facing annular surface and an outer facing annular surface defining an outer diameter across the back-up ring and including a gripping structure for biting into a constraining surface in a well and the first back-up ring and the second back-up ring each are expandable to increase the outer diameter and to expand radially outwardly from the mandrel, wherein the first back-up ring is formed of a first material and the gripping structure includes teeth having a hardness greater than the first material.

2. The wellbore packer back-up ring assembly of claim 1 wherein the first material is resilient.

3. The wellbore packer back-up ring assembly of claim 1 wherein the gripping structure includes inserts installed in the outer annular surface of each back-up ring.

4. The wellbore packer back-up ring assembly of claim 3 wherein the inserts are toothed buttons including carbide and the toothed buttons define the teeth.

5. The wellbore packer back-up ring assembly of claim 1 further comprising a driver for driving the first back-up ring axially along the mandrel toward the second back-up ring and to apply a compressive force to any structure between the first back-up ring and the second back-up ring.

6. The wellbore packer back-up ring assembly of claim 1 wherein the first back-up ring and the second back-up ring each include a cut through their thickness such that each of the first back-up ring and the second back-up ring are formed c-shaped.

7. The wellbore packer back-up ring assembly of claim 1 wherein the first back-up ring and the second back-up ring are each rings including a helical cut extending about their circumference and the first back-up ring and the second back-up ring each expand at the helical cut.

8. The wellbore packer back-up ring assembly of claim 1 wherein the first back up ring includes a pair of connected sub rings being substantially coaxially arranged and rotationally moveable to each other about their axis.

9. The wellbore packer back-up ring assembly of claim 8 wherein the pair of connected sub rings each include a cut through their thickness such that each of the pair of connected sub rings are formed c-shaped and the cuts are offset.

10. The wellbore packer back-up ring assembly of claim 8 wherein the pair of connected sub rings includes a first sub ring and a second sub ring and the first sub ring includes a cut through its thickness such that it is radially expandable relative to the second sub ring.

11. The wellbore packer back-up ring assembly of claim 1 wherein the teeth are 0.050 to 0.060 inches high.

12. The wellbore packer back-up ring assembly of claim 1 wherein the gripping structure is angled to resist axial movement in one direction while allowing it in another direction.

13. The wellbore packer back-up ring assembly of claim 1 wherein the inner facing annular surface is shaped frustoconically.

14. A wellbore packer comprising;

a mandrel, a deformable packing element surrounding the mandrel and adapted to be radially expanded out from the mandrel, the deformable packing element including an end; a back-up ring surrounding the mandrel and positioned adjacent the end of the deformable packing element, the back-up ring having an inner facing annular surface and an outer facing annular surface defining an outer diameter across the back-up ring, the back-up ring being expandable to increase the outer diameter to expand out from the mandrel alongside the deformable packing element and the outer facing annular surface including a gripping structure for biting into a constraining surface in a well, wherein the back-up ring is formed of a first material and the gripping structure includes teeth having a hardness greater than the first material.

15. The wellbore packer of claim 14 wherein the first material is resilient.

16. The wellbore packer of claim 14 wherein the gripping structure includes inserts installed in the outer annular surface of each back-up ring.

17. The wellbore packer of claim 16 wherein the inserts are toothed buttons including carbide and defining the teeth.

18. The wellbore packer of claim 14 wherein further comprising a driver for driving the back-up ring against the deformable packing element to drive the back-up ring and the deformable packing element to radially expand.

19. The wellbore packer of claim 18 wherein the driver drives the back-up ring to radially expand ahead of the deformable packing element.

20. The wellbore packer of claim 14 wherein the back-up ring includes a cut through its thickness, rendering the back-up ring c-shaped.

21. The wellbore packer of claim 14 wherein the driver includes a locking structure to lock the back-up ring and the deformable packing element in an expanded position.

22. The wellbore packer of claim 14 wherein the back-up ring includes a spiral cut extending about its circumference and the back-up ring is expandable at the spiral cut.

23. The wellbore packer of claim 14 wherein the back-up ring includes a pair of connected sub rings being substantially coaxially arranged and rotationally moveable to each other about their axis.

24. The wellbore packer of claim 23 wherein the pair of connected sub rings each include a cut through their thickness such that each of the pair of connected sub rings are formed c-shaped and the cuts are offset.

25. The wellbore packer of claim 23 wherein the pair of connected sub rings includes a first sub ring and a second sub ring and the first sub ring includes a cut through its thickness such that it is radially expandable relative to the second sub ring.

26. The wellbore packer of claim 14 wherein the teeth have a height of 0.050 to 0.060 inches.

27. The wellbore packer of claim 14 wherein the gripping structure is angled to resist axial movement in one direction while allowing it in another direction.

28. The wellbore packer of claim 14 wherein the inner facing annular surface is shaped frustoconically.

29. The wellbore packer of claim 14 wherein the deformable packing element includes a main annular element and at least one guide ring between the main annular element and the back-up ring.

30. The wellbore packer of claim 29 wherein the main annular element is formed of a material softer than the at least one guide ring.

31. A method for sealing an annular area in a wellbore, comprising:

positioning a wellbore packer in a wellbore adjacent a constraining wall, the wellbore packer including a mandrel, a deformable packing element surrounding the mandrel and adapted to be radially expanded out from the mandrel, the deformable packing element including an end; a back-up ring surrounding the mandrel and positioned adjacent the end of the deformable packing element, the back-up ring having an inner facing annular surface and an outer facing annular surface defining an outer diameter across the back-up ring, the back-up ring being expandable to increase the outer diameter to expand out from the mandrel alongside the deformable packing element and the outer facing annular surface including a gripping structure; driving the back-up ring to expand radially outwardly to increase the outer diameter and to drive the gripping structure into engagement with the constraining wall; and applying a force on the deformable packing element to expand it radially outwardly such that seals against the constraining wall, wherein after being driven into engagement with the constraining wall, the gripping structures can slide along the wall with the force applied to the deformable packing element and cannot slide along the wall in an opposite direction.

32. The method of claim 31 wherein the back-up ring is driven into engagement with the constraining wall before the deformable packing element seals against the constraining wall.

33. The method of claim 31 wherein the deformable packing element contacts the back-up ring when sealing against the constraining wall.

34. The method of claim 31 wherein the gripping structure bites into the constraining wall.

35. The method of claim 31 wherein the wellbore packer is anchored to the constraining wall only through the back-up ring.

36. The method of claim 31 further comprising locking the back-up ring in a radially outwardly expanded position.

37. The method of claim 31 wherein the back-up ring includes a cut through its thickness and driving causes the back-up ring to pull apart at the cut.

38. A wellbore packer back-up ring assembly for limiting the extrusion of a packing element in a packer comprising:

a first back-up ring adapted to be positioned about a mandrel at a first end of the packing element; and a second back-up ring adapted to be positioned about the mandrel spaced from the first back-up ring and at a second end of the packing element; wherein the first back-up ring and the second back-up ring each include an inner facing annular surface and an outer facing annular surface defining an outer diameter across the back-up ring and including a gripping structure for biting into a constraining surface in a well and the first back-up ring and the second back-up ring each are expandable to increase the outer diameter and to expand radially outwardly from the mandrel, wherein the gripping structure includes inserts installed in the outer annular surface of each back-up ring.

39. The wellbore packer back-up ring assembly of claim 38 wherein the first back-up ring is formed of a first material and the gripping structure includes teeth having a hardness greater than the first material.

40. The wellbore packer back-up ring assembly of claim 39 wherein the first material is resilient.

41. The wellbore packer back-up ring assembly of claim 38 wherein the inserts are toothed buttons including carbide.

42. The wellbore packer back-up ring assembly of claim 38 wherein further comprising a driver for driving the first back-up ring axially along the mandrel toward the second back-up ring and to apply a compressive force to any structure between the first back-up ring and the second back-up ring.

43. The wellbore packer back-up ring assembly of claim 38 wherein the first back-up ring and the second back-up ring each include a cut through their thickness such that each of the first back-up ring and the second back-up ring are formed c-shaped.

44. The wellbore packer back-up ring assembly of claim 38 wherein the first back-up ring and the second back-up ring are each rings including a helical cut extending about their circumference and the first back-up ring and the second back-up ring each expand at the helical cut.

45. The wellbore packer back-up ring assembly of claim 38 wherein the first back up ring includes a pair of connected sub rings being substantially coaxially arranged and rotationally moveable to each other about their axis.

46. The wellbore packer back-up ring assembly of claim 45 wherein the pair of connected sub rings each include a cut through their thickness such that each of the pair of connected sub rings are formed c-shaped and the cuts are offset.

47. The wellbore packer back-up ring assembly of claim 45 wherein the pair of connected sub rings includes a first sub ring and a second sub ring and the first sub ring includes a cut through its thickness such that it is radially expandable relative to the second sub ring.

48. The wellbore packer back-up ring assembly of claim 38 wherein the gripping structure includes teeth of 0.050 to 0.060 inches high.

49. The wellbore packer back-up ring assembly of claim 38 wherein the gripping structure is angled to resist axial movement in one direction while allowing it in another direction.

50. The wellbore packer back-up ring assembly of claim 38 wherein the inner facing annular surface is shaped frustoconically.

51. A wellbore packer back-up ring assembly for limiting the extrusion of a packing element in a packer comprising:

a first back-up ring adapted to be positioned about a mandrel at a first end of the packing element; and a second back-up ring adapted to be positioned about the mandrel spaced from the first back-up ring and at a second end of the packing element; wherein the first back-up ring and the second back-up ring each include an inner facing annular surface and an outer facing annular surface defining an outer diameter across the back-up ring and including a gripping structure including teeth of 0.050 to 0.060 inches high for biting into a constraining surface in a well and the first back-up ring and the second back-up ring each are expandable to increase the outer diameter and to expand radially outwardly from the mandrel.

52. The wellbore packer back-up ring assembly of claim 51 wherein the first back-up ring is formed of a first material and the teeth have a hardness greater than the first material.

53. The wellbore packer back-up ring assembly of claim 52 wherein the first material is resilient.

54. The wellbore packer back-up ring assembly of claim 51 wherein the gripping structure includes inserts installed in the outer annular surface of each back-up ring.

55. The wellbore packer back-up ring assembly of claim 54 wherein the inserts are buttons including carbide and defining the teeth.

56. The wellbore packer back-up ring assembly of claim 51 wherein further comprising a driver for driving the first back-up ring axially along the mandrel toward the second back-up ring and to apply a compressive force to any structure between the first back-up ring and the second back-up ring.

57. The wellbore packer back-up ring assembly of claim 51 wherein the first back-up ring and the second back-up ring each include a cut through their thickness such that each of the first back-up ring and the second back-up ring are formed c-shaped.

58. The wellbore packer back-up ring assembly of claim 51 wherein the first back-up ring and the second back-up ring are each rings including a helical cut extending about their circumference and the first back-up ring and the second back-up ring each expand at the helical cut.

59. The wellbore packer back-up ring assembly of claim 51 wherein the first back up ring includes a pair of connected sub rings being substantially coaxially arranged and rotationally moveable to each other about their axis.

60. The wellbore packer back-up ring assembly of claim 59 wherein the pair of connected sub rings each include a cut through their thickness such that each of the pair of connected sub rings are formed c-shaped and the cuts are offset.

61. The wellbore packer back-up ring assembly of claim 59 wherein the pair of connected sub rings includes a first sub ring and a second sub ring and the first sub ring includes a cut through its thickness such that it is radially expandable relative to the second sub ring.

62. The wellbore packer back-up ring assembly of claim 51 wherein the gripping structure is angled to resist axial movement in one direction while allowing it in another direction.

63. The wellbore packer back-up ring assembly of claim 51 wherein the inner facing annular surface is shaped frustoconically.

64. A wellbore packer back-up ring assembly for limiting the extrusion of a packing element in a packer comprising:

a first back-up ring adapted to be positioned about a mandrel at a first end of the packing element; and a second back-up ring adapted to be positioned about the mandrel spaced from the first back-up ring and at a second end of the packing element; wherein the first back-up ring and the second back-up ring each include an inner facing annular surface and an outer facing annular surface defining an outer diameter across the back-up ring and including a gripping structure for biting into a constraining surface in a well and the first back-up ring and the second back-up ring each are expandable to increase the outer diameter and to expand radially outwardly from the mandrel, wherein the gripping structure is angled to resist axial movement in one direction while allowing the axial movement in another direction.

65. The wellbore packer back-up ring assembly of claim 64 wherein the first back-up ring is formed of a first material and the gripping structure includes teeth having a hardness greater than the first material.

66. The wellbore packer back-up ring assembly of claim 65 wherein the first material is resilient.

67. The wellbore packer back-up ring assembly of claim 64 wherein the gripping structure includes inserts installed in the outer annular surface of each back-up ring.

68. The wellbore packer back-up ring assembly of claim 67 wherein the inserts are toothed buttons including carbide.

69. The wellbore packer back-up ring assembly of claim 64 wherein further comprising a driver for driving the first back-up ring axially along the mandrel toward the second back-up ring and to apply a compressive force to any structure between the first back-up ring and the second back-up ring.

70. The wellbore packer back-up ring assembly of claim 64 wherein the first back-up ring and the second back-up ring each include a cut through their thickness such that each of the first back-up ring and the second back-up ring are formed c-shaped.

71. The wellbore packer back-up ring assembly of claim 64 wherein the first back-up ring and the second back-up ring are each rings including a helical cut extending about their circumference and the first back-up ring and the second back-up ring each expand at the helical cut.

72. The wellbore packer back-up ring assembly of claim 64 wherein the first back up ring includes a pair of connected sub rings being substantially coaxially arranged and rotationally moveable to each other about their axis.

73. The wellbore packer back-up ring assembly of claim 72 wherein the pair of connected sub rings each include a cut through their thickness such that each of the pair of connected sub rings are formed c-shaped and the cuts are offset.

74. The wellbore packer back-up ring assembly of claim 72 wherein the pair of connected sub rings includes a first sub ring and a second sub ring and the first sub ring includes a cut through its thickness such that it is radially expandable relative to the second sub ring.

75. The wellbore packer back-up ring assembly of claim 64 wherein the gripping structure includes teeth of 0.050 to 0.060 inches high.

76. The wellbore packer back-up ring assembly of claim 64 wherein the inner facing annular surface is shaped frustoconically.

77. A wellbore packer comprising:

a mandrel, a deformable packing element surrounding the mandrel and adapted to be radially expanded out from the mandrel, the deformable packing element including an end; a back-up ring surrounding the mandrel and positioned adjacent the end of the deformable packing element, the back-up ring having an inner facing annular surface and an outer facing annular surface defining an outer diameter across the back-up ring, the back-up ring being expandable to increase the outer diameter to expand out from the mandrel alongside the deformable packing element and the outer facing annular surface including a gripping structure for biting into a constraining surface in a well, wherein the gripping structure includes inserts installed in the outer annular surface of each back-up ring.

78. The wellbore packer of claim 77 wherein the back-up ring is formed of a first material and the gripping structure includes teeth having a hardness greater than the first material.

79. The wellbore packer of claim 78 wherein the first material is resilient.

80. The wellbore packer of claim 77 wherein the inserts are toothed buttons including carbide.

81. The wellbore packer of claim 77 wherein further comprising a driver for driving the back-up ring against the deformable packing element to drive the back-up ring and the deformable packing element to radially expand.

82. The wellbore packer of claim 81 wherein the driver drives the back-up ring to radially expand ahead of the deformable packing element.

83. The wellbore packer of claim 77 wherein the back-up ring includes a cut through its thickness, rendering the back-up ring c-shaped.

84. The wellbore packer of claim 77 wherein the driver includes a locking structure to lock the back-up ring and the deformable packing element in an expanded position.

85. The wellbore packer of claim 77 wherein the back-up ring includes a spiral cut extending about its circumference and the back-up ring is expandable at the spiral cut.

86. The wellbore packer of claim 77 wherein the back-up ring includes a pair of connected sub rings being substantially coaxially arranged and rotationally moveable to each other about their axis.

87. The wellbore packer of claim 86 wherein the pair of connected sub rings each include a cut through their thickness such that each of the pair of connected sub rings are formed c-shaped and the cuts are offset.

88. The wellbore packer of claim 86 wherein the pair of connected sub rings includes a first sub ring and a second sub ring and the first sub ring includes a cut through its thickness such that it is radially expandable relative to the second sub ring.

89. The wellbore packer of claim 77 wherein the gripping structure includes teeth having a height of 0.050 to 0.060 inches.

90. The wellbore packer of claim 77 wherein the gripping structure is angled to resist axial movement in one direction while allowing it in another direction.

91. The wellbore packer of claim 77 wherein the inner facing annular surface is shaped frustoconically.

92. The wellbore packer of claim 77 wherein the deformable packing element includes a main annular element and at least one guide ring between the main annular element and the back-up ring.

93. The wellbore packer of claim 92 wherein the main annular element is formed of a material softer than the at least one guide ring.

94. A wellbore packer comprising:

a mandrel, a deformable packing element surrounding the mandrel and adapted to be radially expanded out from the mandrel, the deformable packing element including an end; a back-up ring surrounding the mandrel and positioned adjacent the end of the deformable packing element, the back-up ring having an inner facing annular surface and an outer facing annular surface defining an outer diameter across the back-up ring, the back-up ring being expandable to increase the outer diameter to expand out from the mandrel alongside the deformable packing element and the outer facing annular surface including a gripping structure including teeth for biting into a constraining surface in a well, the teeth having a height of 0.050 to 0.060 inches.

95. The wellbore packer of claim 94 wherein the back-up ring is formed of a first material and the teeth have a hardness greater than the first material.

96. The wellbore packer of claim 95 wherein the first material is resilient.

97. The wellbore packer of claim 94 wherein the gripping structure includes inserts installed in the outer annular surface of each back-up ring.

98. The wellbore packer of claim 97 wherein the inserts are toothed buttons including carbide.

99. The wellbore packer of claim 94 wherein further comprising a driver for driving the back-up ring against the deformable packing element to drive the back-up ring and the deformable packing element to radially expand.

100. The wellbore packer of claim 99 wherein the driver drives the back-up ring to radially expand ahead of the deformable packing element.

101. The wellbore packer of claim 94 wherein the back-up ring includes a cut through its thickness, rendering the back-up ring c-shaped.

102. The wellbore packer of claim 94 wherein the driver includes a locking structure to lock the back-up ring and the deformable packing element in an expanded position.

103. The wellbore packer of claim 94 wherein the back-up ring includes a spiral cut extending about its circumference and the back-up ring is expandable at the spiral cut.

104. The wellbore packer of claim 94 wherein the back-up ring includes a pair of connected sub rings being substantially coaxially arranged and rotationally moveable to each other about their axis.

105. The wellbore packer of claim 104 wherein the pair of connected sub rings each include a cut through their thickness such that each of the pair of connected sub rings are formed c-shaped and the cuts are offset.

106. The wellbore packer of claim 104 wherein the pair of connected sub rings includes a first sub ring and a second sub ring and the first sub ring includes a cut through its thickness such that it is radially expandable relative to the second sub ring.

107. The wellbore packer of claim 94 wherein the teeth are angled to resist axial movement in one direction while allowing it in another direction.

108. The wellbore packer of claim 94 wherein the inner facing annular surface is shaped frustoconically.

109. The wellbore packer of claim 94 wherein the deformable packing element includes a main annular element and at least one guide ring between the main annular element and the back-up ring.

110. The wellbore packer of claim 109 wherein the main annular element is formed of a material softer than the at least one guide ring.

111. A wellbore packer comprising:

a mandrel, a deformable packing element surrounding the mandrel and adapted to be radially expanded out from the mandrel, the deformable packing element including an end; a back-up ring surrounding the mandrel and positioned adjacent the end of the deformable packing element, the back-up ring having an inner facing annular surface and an outer facing annular surface defining an outer diameter across the back-up ring, the back-up ring being expandable to increase the outer diameter to expand out from the mandrel alongside the deformable packing element and the outer facing annular surface including a gripping structure for biting into a constraining surface in a well, wherein the gripping structure is angled to resist axial movement in one direction while allowing the axial movement in an opposite direction.

112. The wellbore packer of claim 111 wherein the back-up ring is formed of a first material and the gripping structure includes teeth having a hardness greater than the first material.

113. The wellbore packer of claim 112 wherein the first material is resilient.

114. The wellbore packer of claim 111 wherein the gripping structure includes inserts installed in the outer annular surface of each back-up ring.

115. The wellbore packer of claim 114 wherein the inserts are toothed buttons including carbide.

116. The wellbore packer of claim 111 wherein further comprising a driver for driving the back-up ring against the deformable packing element to drive the back-up ring and the deformable packing element to radially expand.

117. The wellbore packer of claim 116 wherein the driver drives the back-up ring to radially expand ahead of the deformable packing element.

118. The wellbore packer of claim 111 wherein the back-up ring includes a cut through its thickness, rendering the back-up ring c-shaped.

119. The wellbore packer of claim 111 wherein the driver includes a locking structure to lock the back-up ring and the deformable packing element in an expanded position.

120. The wellbore packer of claim 111 wherein the back-up ring includes a spiral cut extending about its circumference and the back-up ring is expandable at the spiral cut.

121. The wellbore packer of claim 111 wherein the back-up ring includes a pair of connected sub rings being substantially coaxially arranged and rotationally moveable to each other about their axis.

122. The wellbore packer of claim 121 wherein the pair of connected sub rings each include a cut through their thickness such that each of the pair of connected sub rings are formed c-shaped and the cuts are offset.

123. The wellbore packer of claim 121 wherein the pair of connected sub rings includes a first sub ring and a second sub ring and the first sub ring includes a cut through its thickness such that it is radially expandable relative to the second sub ring.

124. The wellbore packer of claim 111 wherein the gripping structure includes teeth having a height of 0.050 to 0.060 inches.

125. The wellbore packer of claim 111 wherein the inner facing annular surface is shaped frustoconically.

126. The wellbore packer of claim 111 wherein the deformable packing element includes a main annular element and at least one guide ring between the main annular element and the back-up ring.

127. The wellbore packer of claim 126 wherein the main annular element is formed of a material softer than the at least one guide ring.

* * * * *